US006446939B1

(12) United States Patent
Hoppe et al.

(10) Patent No.: US 6,446,939 B1
(45) Date of Patent: Sep. 10, 2002

(54) MODULAR DIAPHRAGM CARBURETOR

(75) Inventors: Jeffrey C. Hoppe, Unionville; Ronald H. Roche, Cass City; Kevin L. Williams, Columbiaville, all of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/650,166

(22) Filed: Aug. 29, 2000

(51) Int. Cl.[7] ..... F02M 17/04

(52) U.S. Cl. ..... 261/35; 261/40; 261/41.1; 261/69.1; 261/DIG. 8; 261/DIG. 68

(58) Field of Search ..... 261/35, 40, 41.1, 261/69.1, 69.2, DIG. 8, DIG. 68, DIG. 84

(56) References Cited

U.S. PATENT DOCUMENTS 2,713,854 A * 7/1955 Conover ..... 261/35 X
2,796,838 A * 6/1957 Phillips ..... 261/35 X
3,065,957 A * 11/1962 Phillips ..... 261/35
3,104,617 A * 9/1963 Barr ..... 261/DIG. 68
3,160,683 A * 12/1964 Johnson ..... 261/35 X
3,272,485 A * 9/1966 Newman ..... 261/35
3,738,623 A * 6/1973 Tuckey ..... 261/69.2 X
3,746,320 A * 7/1973 Van Camp et al. ..... 261/35
3,825,237 A * 7/1974 Aoyama et al. ..... 261/35
4,003,968 A * 1/1977 Rickert ..... 261/35
4,824,613 A * 4/1989 Scott et al. ..... 261/DIG. 8
5,250,233 A 10/1993 Swanson ..... 261/34.2
5,283,013 A * 2/1994 Gerhardy ..... 261/35
5,891,369 A * 4/1999 Tuggle et al. ..... 261/DIG. 8

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A modular diaphragm carburetor is provided which has a plurality of plates each with generally planar faces adapted to be mated and releasably connected together to facilitate manufacturing and assembling the carburetor and to permit various plates and components of the carburetor to be used in carburetors designed for use with different engine families. By providing a plurality of mated together plates, the machining of the passages through the carburetor is made dramatically easier when compared to the machining of a carburetor having a single body with end caps. Still further, the modular diaphragm design permits different plates and/or components of the carburetor to be used with other components to provide a carburetor having different performance characteristics and suitable for use with a different engine family. Therefore, a wide range of carburetors can be provided which have many of the same components to reduce the overall part count and to more economically manufacture and assemble a wide range of carburetors.

40 Claims, 8 Drawing Sheets

MODULAR DIAPHRAGM CARBURETOR

FIELD OF THE INVENTION

This invention relates generally to carburetors and more particularly to a modular diaphragm type carburetor.

BACKGROUND OF THE INVENTION

Typically, carburetors have been used to supply a fuel and air mixture to both four stroke and two stroke internal combustion engines. For many applications where small two stroke engines are utilized, such as hand held power chain saws, weed trimmers, leaf blowers, garden equipment and the like, carburetors with both a diaphragm fuel delivery pump and diaphragm fuel metering system have been utilized. Typically, these carburetors comprise a main body having a pair of end caps each of which traps a separate one of the fuel pump diaphragm and fuel metering diaphragm against the carburetor body and defines various fuel pump chambers or fuel metering chambers.

To transfer fuel from the fuel pump assembly to the fuel metering system and thereafter to a throttle or venturi bore in the carburetor body for delivery of a rich fuel and air mixture to the engine, as well as to provide air flow and pressure control signals through the carburetor, a plurality of passages must be formed in the carburetor body and a number of pockets or recesses are formed in the various chambers within the body to facilitate communicating desired passages with each other. This machining is intricate, time consuming and therefore greatly increases the cost to manufacture the carburetors. Further, cavities or recesses must also be provided to receive valves or other components between the fuel metering diaphragm and the body of the carburetor. These cavities or recesses can trap vapor bubbles which coalesce to form large vapor bubbles. The large vapor bubbles are eventually drawn through the carburetor and delivered to the engine making the fuel and air mixture delivered to the engine temporarily overly lean and contributing to poor engine performance. Still further, the various components of the carburetor are assembled in many directions which increases the manual labor needed to assemble the carburetor and thereby increases the cost to manufacture and assemble them.

In a conventional carburetor having a main body wherein a plurality of passages and openings are machined, it is extremely difficult and often not possible to use a particular carburetor body on more than one engine family. Still further, due to the difficulty in machining and assembling the carburetor body, there is a significant variation from carburetor to carburetor. This carburetor to carburetor variation must be compensated for by initially calibrating each carburetor to its desired performance which can be difficult to do with the conventional needle valve assembly and fuel metering arrangement in conventional carburetors.

SUMMARY OF THE INVENTION

A modular diaphragm carburetor is provided which has a plurality of plates each with generally planar faces adapted to be mated and releasably connected together to facilitate manufacturing and assembling the carburetor and to permit various plates and components of the carburetor to be used in other carburetors designed for use with different engine families. By providing a plurality of mated together plates, the machining of the passages through the carburetor is made dramatically easier compared to the machining of a carburetor having a single body with end caps. Still further, the modular diaphragm design permits different plates and/or components of the carburetor to be used with other components to provide a carburetor having different performance characteristics and suitable for use with a different engine family. Therefore, a wide range of carburetors can be provided which have many of the same components to reduce the overall part count and to more economically manufacture and assemble a wide range of carburetors.

To also increase the flexibility of the carburetor, an improved system is provided for controlling the operating vacuum pressure of a fuel metering system of the carburetor. By changing the operating vacuum of the fuel metering system, the flow characteristics through the carburetor can be changed as desired to suit particular engine families. Desirably, a valve which controls the flow of fuel to a fuel metering chamber in the carburetor can be opened by a disk responsive to movement of the fuel metering diaphragm to control the flow of fuel into the fuel metering chamber. Further, the working length of a spring yieldably biasing the valve to its closed position can be changed to change the force acting on the inlet valve. With this arrangement, the diameter, construction and mass of the disk, the flexibility of the fuel metering diaphragm, the design of the inlet valve and its seat, and the magnitude of the spring force biasing the inlet valve to its closed position all contribute to the average magnitude of the vacuum at which the fuel metering chamber operates. Therefore, the average operating vacuum of the fuel metering chamber can be varied by varying any one or more of the above components to ensure proper operation of the carburetor on various engine families.

It is also important that the operating vacuum of the fuel metering To chamber be consistent from carburetor to carburetor on the same engine family. With all other factors being essentially equal, the operating vacuum of the metering chamber can be readily altered by modifying the working length of the spring biasing the inlet valve to change the force exerted on the inlet valve by the spring. In conventional carburetors, to change the spring force acting on the inlet valve, it was necessary to replace the spring with another spring having a different spring rate. Therefore, permitting the adjustment of the working length of the spring facilitates calibrating the carburetor for consistent performance on the same engine family and also facilitates use of the carburetor on various engine families.

By changing the operating vacuum of the fuel metering chamber, the fuel flow characteristics of the carburetor are changed. Desirably, the fuel flow characteristics can be controlled in this manner without the use of any needle valves typically found in conventional carburetors, to facilitate calibrating the carburetor and ensure that it is tamper proof so that an end user cannot easily adjust the carburetor out of a desired operating range. If desired, needle valves may still be employed to control in part the fuel flow characteristics of the carburetor if desired for a particular application.

Objects, features and advantages of this invention include providing a carburetor which has a body formed from a plurality of plates to facilitate manufacture and machining of the various passages in the carburetor, facilitates adjustment from carburetor to carburetor for use with the same engine family, facilitates adjustment of the carburetor for use on different engine families, enables use of various carburetor components in assembly of a different carburetor for a different engine family, facilitates adjustment of the operating pressure of a fuel metering chamber, permits final assembly from a single direction, permits various subsystems of the carburetor to be tested independently of one another before final assembly, permits a fuel pump portion of the carburetor to be formed without machining, permits an increased fuel filter area without degradation of performance of the carburetor, permits use of flat, non-convoluted diaphragms, reduces cavities or pockets in fuel chambers and fuel passages to reduce vapor bubble collection, permits direct access to a spring biasing a fuel metering inlet valve to permit its working length to be adjusted, is of relatively simple design and economical manufacture and assembly, reliable, durable and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
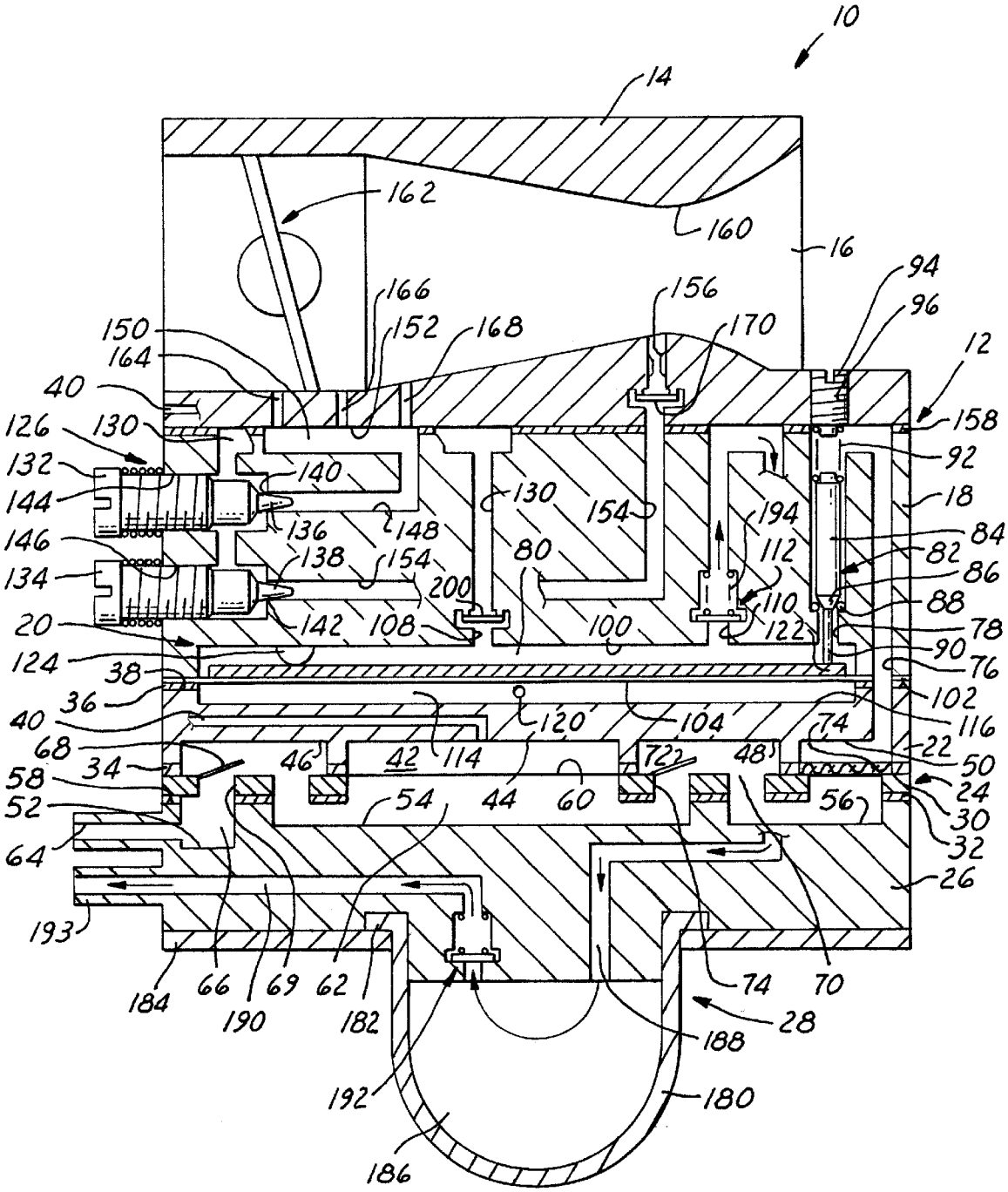
FIG. 1 is a sectional view of a carburetor embodying the present invention.

Referring in more detail to the drawings, FIG. 1 illustrates a carburetor 10 according to a first embodiment of the present invention which has a main body 12 formed from a plurality of separate plates releasably attached together to facilitate the manufacture and assembly of the carburetor 10. A throttle valve plate 14 has a fuel and air mixing passage 16 therethrough and is attached to a fuel metering plate 18 which defines in part a fuel metering assembly 20 which controls the flow of fuel through the carburetor 10. The fuel metering plate 18 is connected to a fuel pump plate 22 which defines in part a fuel pump assembly 24 which draws fuel from a fuel tank and delivers it to the fuel metering assembly 20. An end plate 26 defines in part the fuel pump assembly 24 and also a purge pump assembly 28 which facilitates removing air from and drawing fuel into the carburetor before initial operation of the engine. Desirably, with the carburetor 10 formed by the plurality of plates 14, 18, 22, 26 the machining of the various fluid passages throughout the carburetor 10 can be eliminated or at least substantially reduced with many of the passages and chambers defined by recesses which can be formed in the faces of the plates when they are die cast. Still further, by forming the carburetor body out of the plurality of plates, any check valves, needle valves, diaphragms and other carburetor components can be installed within the carburetor body as opposed to just on the outer ends of the one-piece body adjacent to end caps of conventional carburetors.

The Fuel Pump Assembly

The fuel pump plate 22 has opposed generally planar faces and in assembly is received between a valve seat plate 30 adjacent to the end plate 26 and the fuel metering plate 18. Gaskets 32, 34, 36, respectively, are provided between the valve seat plate 30 and the end plate 26, between the valve seat plate 30 and the fuel pump plate 22, and between a face 38 of the fuel pump plate 22 and the fuel metering plate 18. The fuel pump plate 22 has a pressure pulse passage 40 formed therein which extends through the fuel metering plate 18 and into the throttle valve plate 14 to communicate at one end with a crankcase of the engine. The pressure pulse passage 40 opens to a pressure pulse chamber 42 defined in part by a first recess 44 in the fuel pump plate 22. Second, third and fourth recesses 46, 48, 50 in the fuel pump plate 22 define in part a fuel flow path of the fuel pump assembly 24. The fuel flow path is also defined in part by first, second and third cavities 52, 54, 56 formed in the adjacent face 58 of the end plate 26. The fuel pump 24 has a flexible diaphragm 60 carried between the fuel pump plate 22 and the end plate 26 and preferably trapped between the valve seat plate 30 and the gasket 34. The fuel pump diaphragm 60 defines in part a fuel pump chamber 62 on one side and the pressure pulse chamber 42 on its other side and is displaceable in response to a difference in pressure between the chambers 42, 62.

When the engine is running, pressure pulses from its crankcase are directed to the pressure pulse chamber 42 via the pressure pulse passage 40. When a negative pressure pulse is transmitted to the pulse chamber 42, the flexible fuel pump diaphragm 60 is moved in a direction increasing the volume of the fuel pump chamber and decreasing the volume of the pressure pulse chamber 42. The increase in the fuel pump chamber volume draws fuel from a fuel pump reservoir or tank (not shown) through an inlet 64 formed in the end plate 26, and into an inlet surge chamber 66 defined between an inlet valve 68 and the first cavity 52 in the end plate. The inlet valve 68 controls fluid flow from the inlet surge chamber 66 to the fuel pump chamber 62 and is preferably a flap type valve integral with the diaphragm 60 and adapted to selectively engage the valve seat plate 30 to close an inlet opening 69 in the plate 30. The pressure drop caused by the increase in volume of the fuel pump chamber 62 causes the inlet valve 68 to open and to permit fuel to flow from the inlet 64 to the fuel pump chamber 62.

During the engine cycle, as the pressure in the engine crankcase is increased, a positive pressure pulse will be transmitted through the crankcase pressure pulse passage to the pressure pulse chamber 42 to cause the diaphragm 60 to move in a direction decreasing the volume of the fuel pump chamber 62 and increasing the volume of the pressure pulse chamber 42. The decrease in volume of the fuel pump chamber 62 increases the pressure therein and thereby closes the inlet valve 68 and forces fuel in the fuel pump chamber 62 toward an outlet surge chamber 70 defined between an outlet valve 72 and the third cavity 56 in the end plate 26. The outlet valve 72 is also preferably a flap type valve integral with the diaphragm 60 and adapted to selectively engage the valve seat plate 30 to close an outlet opening 74 of the plate 30. When a negative pressure condition exists in the fuel pump chamber 62, the outlet valve 72 is closed and a positive pressure in the fuel pump chamber 62 opens the outlet valve 72 to permit the fuel to be forced from the fuel pump chamber 62 to the outlet surge chamber 70 for subsequent delivery to the downstream fuel metering assembly 20. A fuel filter 74 such as a screen or other porous member is preferably disposed between the valve seat plate 30 and the fuel pump plate 22. Desirably, defining the outlet surge chamber 70 and disposing the fuel filter 74 between the adjacent plates 22, 30 permits the fuel filter 74 to have a greater surface area than in conventional carburetors to extend the life of the fuel filter in use before the performance of the fuel pump 24 is adversely affected.

Fuel Metering Assembly

Fuel which passes through the fuel filter 74 enters a fuel metering inlet passage 76 and is delivered under pressure to the fuel metering assembly 20 of the carburetor 10. The fuel metering assembly 20 of the carburetor functions as a pressure regulator receiving pressurized fuel from the fuel pump assembly 24 and regulating its pressure to a predetermined pressure, usually subatmospheric, to control the delivery of the fuel from the fuel metering assembly. The fuel metering inlet passage 76 leads to an inlet 78 of a fuel metering chamber 80 to provide fuel into the fuel metering chamber. An inlet valve 82 selectively permits fuel flow from the inlet passage 76 to the fuel metering chamber 80. The inlet valve 82 has a valve body 84, a generally conical valve head 86 extending from the body and engageable with an annular valve seat 88 which defines the inlet of the fuel metering chamber 80, and a needle 90 extending through the valve seat 88 and into the fuel metering chamber 80. A spring 92 bears on the end of the body 84 opposite the needle 90 to yieldably bias the valve 82 to its closed position with the valve head 86 bearing on the valve seat 88 to prevent fuel flow into the fuel metering chamber 80. At its other end the spring 92 bears on an adjustment member embodied as a screw 94 received in a threaded bore 96 through the throttle valve plate 14. The position of the screw 94 in the bore 96 can be adjusted to adjust the working length of the spring 92 and hence, the spring force acting on the inlet valve 82 to change the operating characteristics of the inlet valve.

The fuel metering chamber 80 is defined in part by a cavity 100 open to one face 102 of the fuel metering plate 18 and by a diaphragm 104 trapped about its periphery between the fuel metering plate 18 and the fuel pump plate 22 preferably with the gasket 36 between the diaphragm 104 and the fuel pump plate 22 to reduce tolerance stack-up. The fuel metering chamber 80 also has a fuel outlet 108 through which fuel is discharged to be delivered to the engine, and a purge outlet 110 having a check valve 112 to permit fluid flow therethrough only when the purge pump assembly 28 is actuated to facilitate removing any fuel vapor or air from the fuel metering chamber 80 and filling it with liquid fuel prior to initial operation of the engine. On the other side of the fuel metering diaphragm 104, an air chamber 114 is defined within a cavity 116 open to the adjacent face 38 of the fuel pump plate 22. The air chamber 114 is maintained at atmospheric pressure by a vent 120 in the chamber 114 which communicates with an atmospheric pressure source, such as the exterior of the carburetor. Desirably, the fuel metering chamber 80 and air chamber 114 are defined by cavities 100, 116 formed in and open to generally planar faces 102, 38 of their respective plates 18, 22 to facilitate the manufacture of these chambers which may be formed without any machining when the plates 18, 22 are die cast. A substantially rigid disk 122 is disposed in the fuel metering chamber 80 between the fuel metering diaphragm 104 and one or more fixed pivots 124 extending from the fuel metering plate 18 into the fuel metering chamber 80. The disk 122 extends from the fixed pivot points 124 and underlies the needle 90 of the inlet valve 82.

Fuel flows out of the metering chamber fuel outlet 108 in response to pressure pulses produced in an engine intake manifold which propagate through the fuel and air mixing passage 16, through a fuel flow control assembly 126 and to the fuel metering chamber 80. A negative pressure pulse transmitted to the fuel metering chamber 80 draws fuel out of the metering chamber fuel outlet 108 creating a pressure differential between the fuel metering chamber and the air chamber 114. This pressure differential across the fuel metering diaphragm 104 causes the diaphragm 104 to move in a direction tending to decrease the volume of the fuel metering chamber 80 and increase the volume of the air chamber 114.

This movement of the fuel metering diaphragm 104 moves the disk 122 in a similar direction. Movement of the disk 122 causes it to engage the fixed pivots 124 along one side which tends to rock or pivot the disk 122 into engagement with the needle 90 of the inlet valve 82 at its opposite side. As the pressure differential between the metering chamber 80 and the air chamber 114 increases, the force exerted on the disk 122 by the diaphragm 104 is eventually sufficient to displace the inlet valve 82 to an open position permitting flow of the pressurized fuel in the inlet passage 76 to the fuel pump metering chamber 80. As the pressurized fuel enters the fuel metering chamber 80, the pressure therein increases thereby reducing the pressure differential across the diaphragm 114. Likewise, the force exerted on the disk 122 by the diaphragm 104 is then decreased until eventually the force is insufficient to overcome the force biasing the inlet valve 82 to its closed position whereby the inlet valve closes and the flow of fuel into the fuel metering chamber 80 is prevented. In this manner, the inlet valve 82 is continuously cycled between open and closed positions in response to the pressure differential across the fuel metering diaphragm 104 to maintain the fuel in the metering chamber 80 at a constant average pressure relative to the pressure in the air chamber 114. Notably, because a negative pressure pulse from the intake manifold is used to actuate the fuel metering diaphragm 104, the average pressure in the fuel metering chamber 80 is at least slightly subatmospheric.

Figure 2:
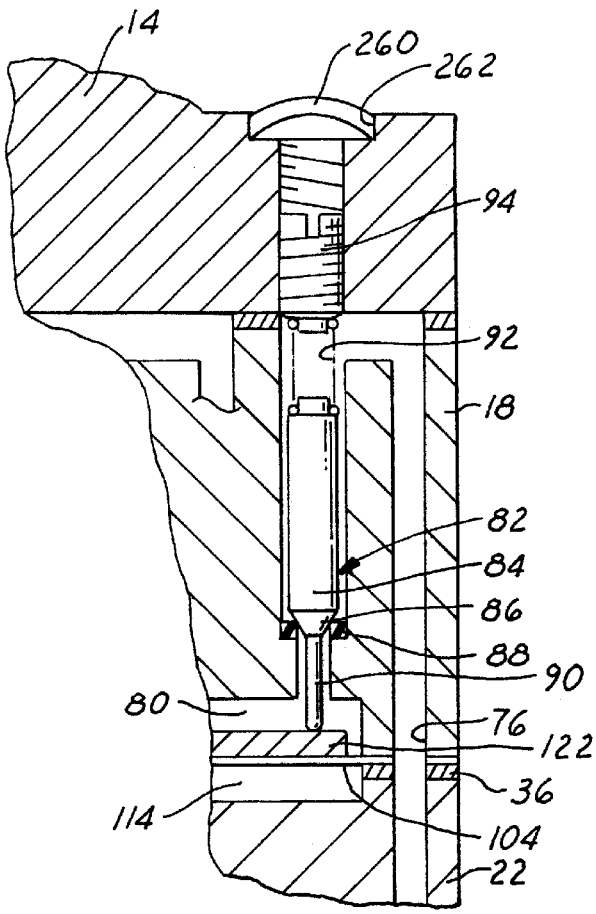
FIG. 2 is an enlarged fragmentary sectional view illustrating a plug used to prevent access to an inlet valve of the carburetor.
Figure 3:
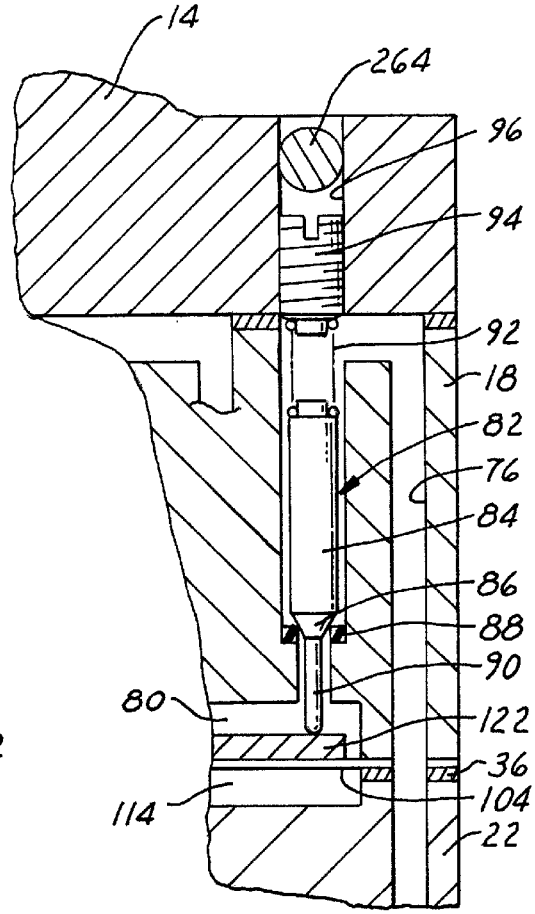
FIG. 3 is an enlarged fragmentary sectional view illustrating another plug used to prevent access to the inlet valve.

To render the carburetor 10 tamper proof by the final consumer, a welch plug 260 as shown in FIG. 2 may be inserted in a counterbore 262 of the throttle valve plate 14 to prevent access to the screw 94, or a ball plug 264 may be inserted into the bore 96 as shown in FIG. 3. The welch plug 260 and ball 264 cannot be removed without a special tool to deter after calibration adjustment of the carburetor 10 by the final consumer.

Providing the flat disk 122 in the fuel metering chamber 80 to actuate the inlet valve 82 eliminates many of the pockets or cavities required in conventional carburetors to accommodate the levers, inlet valve and a spring biasing the valve lever. Each of these cavities in a conventional carburetor creates a discontinuous surface of the carburetor body in which fuel vapor can collect and coalesce until eventually it is drawn through the fuel passages of the carburetor and delivered to the engine providing a temporarily lean fuel and air mixture to the engine which is undesirable. Further, with the flat disk 122 on the fuel metering diaphragm 104, no holes or openings need be formed through the fuel metering diaphragm 104 as in prior carburetors thereby simplifying its manufacture and assembly into the carburetor and increasing its in service useful life. Desirably, capillary forces between the disk 122 and the wet fuel metering diaphragm 104 are sufficient under normal operating conditions to maintain the disk 122 in contact with the diaphragm 104 so that the disk 122 moves with the diaphragm to actuate the inlet valve 82. Therefore, the disk 122 not only provides a simpler lever or actuating mechanism for the inlet valve 82, it also eliminates a number of the pockets in which fuel vapor collects in conventional carburetors.

Desirably, the fuel metering diaphragm 104 is a generally flat polymeric sheet and is flexible to move in response to a differential pressure across it. Also preferably, the diaphragm 60 is formed of a material that swells when exposed to liquid fuel to increase its flexibility and responsiveness. A swell of 2% to 10% is desirable because it increases the flexibility of the diaphragm without having to artificially stretch the diaphragm which makes assembly difficult. A currently preferred material for the fuel metering diaphragm is high density polyethylene because it has excellent flexibility, strength, is resistant to degradation in fuel and resists developing a static charge. The diaphragm is preferably between 0.5 to 2 mil. thick. Other polymers may also be used such as, for example, linear low density polyethylene, low density polyethylene, chlorotrifluoroethylene copolymers, polyvinylidene fluoride, polyvinyl fluoride, polyamide, polyether ether keytone, and fluorinated ethylene propylene, to name a few.

Fuel Flow Control Assembly

Fuel discharged from the fuel metering chamber fuel outlet 108 flows into a main fuel delivery passage 130 of the fuel flow control assembly 126. The main fuel delivery passage 130 leads to an adjustable low speed needle valve 132 and an adjustable high speed needle valve 134 downstream of the low speed needle valve. Each needle valve 132, 134 is of generally conventional construction having a needle shaped tip or valve head 136, 138 extending through an annular valve seat 140, 142 to define an annular flow area which is adjustable in size by axially advancing or retracting the needle valve relative to the valve seat by turning it in its threaded bore 144, 146 in the fuel metering plate 18. Fuel which flows through the valve seat 140 of the low speed needle valve 132, flows into a low speed fuel delivery passage 148, to a progression pocket 150 which leads to a plurality of fuel jets in the throttle valve plate 14. Desirably, the progression pocket 150 is a recess formed in the face 152 of the fuel metering plate 18. Fuel which flows through the valve seat 142 of the high speed needle valve 134 enters a high speed fuel delivery passage 154 which leads to a high speed fuel nozzle 156 which is open to the fuel and air mixing passage 16. The high speed fuel nozzle 156 may comprise a restriction or nozzle disposed in a portion of the high speed fuel delivery passage 154 which extends in the throttle valve plate 14 to the fuel and air mixing passage 16.

The throttle valve plate 14 is fixed to the fuel metering plate 18 with a gasket 158 between them. The throttle valve plate 14 has the fuel and air mixing passage 16 formed therein with a venturi portion 160 upstream of a throttle valve 162 received in the passage 16. The throttle valve 162 is preferably a butterfly type valve and is movable from an idle position substantially closing the fuel and air mixing passage 16 to limit the fluid flow therethrough, to a wide open position generally parallel with the axis of the passage 16 to permit a substantially unrestricted fluid flow therethrough. A portion of the pressure pulse passage 40 is formed in the throttle valve plate 14 as is a portion of the high speed fuel delivery 154 passage, with the high speed nozzle 156 therein, and the plurality of fuel jets open to the progression pocket 150 of the fuel metering plate 18. The plurality of fuel jets comprise a primary fuel jet 164 disposed downstream of the throttle valve 162 when it is in its closed position and one or more secondary fuel jets 166, 168 disposed upstream of the throttle valve 162 when it is in its closed position. More or less than the number of primary and secondary fuel jets 164, 166, 168 shown may be used as desired for a particular application.

Fuel flows from the fuel metering chamber 80 through the main fuel delivery passage 130, the fuel needle valves 132, 134 and eventually to the idle fuel jets 164, 166, 168 and high speed fuel nozzle 156 in response to the manifold pressure signals as previously mentioned. As shown in FIG. 1, during engine idle operating conditions, the throttle valve 162 is in its idle position substantially closing the fuel and air mixing passage 16. The manifold negative pressure signal is prevented from reaching the high speed fuel nozzle 156 by the throttle valve 162. Thus, there is no fuel flow past the high speed needle valve 134 because there is little or no pressure drop across the high speed fuel nozzle 156 to induce a flow through the high speed fuel delivery passage 154.

At idle fuel flow required to operate the engine is supplied through the low speed fuel delivery passage 148 which leads to the progression pocket 150. However, the secondary fuel jets 166, 168 are also not exposed to the manifold vacuum signal due to their position upstream of to the throttle valve 162 when it is in its idle position. Rather, air flowing through the fuel and air mixing passage 16 bleeds through the secondary fuel jets 166, 168 into the progression pocket 150 providing a fuel and air mixture within the progression pocket. Air flow from the fuel and air mixing passage 16 through the high speed fuel delivery passage 154 is preferably prevented by a check valve 170 disposed in the throttle valve plate 14 to control the quantity of air provided to fuel progression pocket 150. The primary fuel jet 164 is exposed to the manifold vacuum signal and hence, the fuel and air mixture within the progression pocket 150 is drawn through the primary fuel jet 164 into the fuel and air mixing passage 16 whereupon it is combined with the air flowing through the passage 16 to be delivered to the engine. Therefore, at engine idle operating conditions all the fuel delivered to the engine is supplied through the primary fuel jet 164. The air bleed through the secondary fuel jets 166, 168 is desirable to provide air into the progression pocket 150 and thereby reduce the rate at which liquid fuel is drawn through the primary fuel jet 164 in use. If the secondary fuel jets 166, 168 were not present and air was not provided into the progression pocket 150, too much liquid fuel would flow through the primary fuel jet 164 if it were maintained the same size, or in the alternative, a much smaller and much harder to manufacture primary fuel jet would be required to provide the proper liquid fuel flow rate to operate the engine properly at idle operating conditions.

As the throttle valve 162 is rotated from its idle position to its wide open position to increase engine speed, the manifold vacuum from the engine is increasingly exposed to the secondary fuel jets 166, 168. At some point during the throttle valve opening, the negative pressure or pressure drop across the secondary fuel jets 166, 168 becomes great enough such that air is no longer fed from the fuel and air mixing passage 16 into the progression pocket 150 but rather, fuel in the progression pocket is drawn through the secondary fuel jets 166, 168 into the fuel and air mixing passage 16. The size and spacing of the primary fuel jet 164 and each of the secondary fuel jets 166, 168 in relationship to each other and the throttle valve 162 is very important to the proper operation of a specific engine to ensure that the desired fuel and air mixture is supplied to the engine during its wide range of operating conditions.

When the throttle valve 162 is opened further to its wide open position, the engine manifold vacuum signal reaches the venturi 160 and the high speed fuel nozzle 156 creating a pressure drop across the fuel nozzle 156 and drawing fuel therethrough to be mixed with air flowing through the fuel and air mixing passage 16. Air flow through the venturi 160 also creates a pressure drop across the high speed fuel nozzle 156 to increase the fuel drawn therethrough. The increased vacuum across the high speed fuel nozzle 156 provides an increased flow of fuel through the high speed fuel nozzle which is required for good engine acceleration when the throttle valve 162 is quickly opened from its idle position to its wide open position. The flow area and position of the high speed fuel nozzle 156 relative to the throttle valve 162 and the venturi 160 is important to ensure the desired fuel and air mixture is provided to the engine. At wide open throttle engine operating conditions, a portion of the fuel is also preferably delivered from the primary and secondary fuel jets 164, 166, 168 in addition to that supplied through the high speed fuel nozzle 156.

Air Purge Assembly

The air purge assembly 28 is used to prime the carburetor to ensure that liquid fuel is present in all passages from the fuel reservoir to the fuel metering chamber 80 and to remove air and fuel vapor therefrom before the engine is started. This greatly reduces the number of engine revolutions required to start the engine. The air purge assembly 28 comprises a bulb 180 having a radially outwardly extending rim 182 trapped between a cover 184 and the end plate 26 defining a bulb chamber 186, an air purge inlet passage 188 extending from the purge outlet 110 of the fuel metering chamber 80 to the bulb chamber 186, and an air purge outlet passage 190 leading from the bulb chamber 186 to a purge outlet 191 leading to a fuel reservoir through which fluid pumped out of the carburetor 10 is discharged to the reservoir. A check valve 192 closes the air purge outlet passage 190 until a sufficient pressure within the bulb chamber 186 displaces the check valve 192 to permit fluid flow therethrough into the reservoir. Similarly, the check valve 112 closes the purge outlet 110 of the fuel metering chamber 80 to prevent fluid flow from the bulb chamber 186 to the fuel metering chamber 80 when the bulb is depressed and to permit fluid flow out of the fuel metering chamber 80 to the bulb chamber 186 only when a sufficient pressure differential exists across the check valve 112 to open it against the bias of a spring 194 tending to close it.

The air purge process is initiated by depressing the bulb 180 which pushes the air, fuel vapor and/or fuel within the bulb chamber 186 through the outlet passage check valve 192 and the outlet passage 190 back to the fuel reservoir. The check valve 112 at the purge outlet 110 prevents any fluid from being pushed into the fuel metering chamber 80. When the bulb 180 is released, the volume of the bulb chamber 186 increases creating a vacuum because the outlet check valve 192 does not permit fluid flow back into the bulb chamber 186. The vacuum is transmitted through the air purge inlet passage 188 to the check valve 112 at the metering chamber purge outlet 110. The spring 194 biasing this check valve 112 determines the magnitude or force of the vacuum required to open it and permit fluid in the metering chamber 80 to flow through the air purge inlet passage 188 to the bulb chamber 186. This check valve spring 194 also adds an extra force to the check valve 112 relative to the negative pressure prevailing within the fuel metering chamber 80 during engine operation, to ensure a good seal between the metering chamber 80 and air purge inlet passage 188 to prevent fluid leakage from the fuel metering chamber during all engine operating conditions (exclusive of the air purge process). When the vacuum at the check valve 112 is sufficient to open it, fluid within the fuel metering chamber 80 is drawn through the air purge inlet passage 188 into the bulb chamber 186. Subsequent depression of the bulb 180 then forces this fluid through the check valve 192 and the outlet passage 190 to the fuel reservoir.

The vacuum transmitted to the fuel metering chamber 80 during the purge process when the check valve 112 is open also displaces the diaphragm 104 and disk 122 toward the inlet valve 82 to open it and thereby draw fuel through the fuel pump 24, the fuel metering inlet passage 76 and into the fuel metering chamber 80 to fill them all with liquid fuel. A check valve 200 at the fuel outlet 108 of the fuel metering chamber 80 is closed by the application of the air purge vacuum to the fuel metering chamber 80 to prevent air from being pulled from the fuel and air mixing passage 16, through the fuel jets 164, 166, 168 and fuel delivery passages 130, 148, 154 into the fuel metering chamber 80. Several actuations or depressions of the bulb 180 may be necessary to draw fuel from the reservoir, through the fuel pump assembly 24 and fuel metering assembly 20 and finally into the bulb chamber 186. The number of actuations of the bulb 180 required is a function of the volume of the bulb chamber 186 compared to the volume of the passages that lead from the fuel reservoir to the bulb chamber.

In conventional diaphragm carburetors, both the air purge inlet passage check valve 112 and air purge outlet passage check valve 192 are placed within the air purge body or a corresponding portion of the one piece carburetor body. Because each of the valves 112, 192 have to check flow in different directions, different valve designs must be used to allow proper assembly from the same direction, or the valves must be assembled from two different directions thereby increasing the cost to manufacture and assemble the carburetor. According to the present invention, the same check valve design may be used for both valves 112, 192, with both valves operating and being assembled in the same direction, by moving the air purge inlet check valve 112 to the fuel metering plate 18 adjacent to the fuel metering chamber 80 as shown and described. Additionally, as previously mentioned, another benefit to the placement of the air purge inlet check valve 112 adjacent to the purge outlet 110 of the fuel metering chamber 80 is that this minimizes the potential leakage of fuel from the fuel metering chamber 80 or beyond the gaskets between the various plates 14, 18, 22, 24 communicated with the air purge inlet passage 188. In conventional diaphragm carburetors, the entire air purge inlet passage 188 upstream of the air purge inlet check valve 112 is open to the fuel metering chamber 80. Any fluid leakage into or out of the metering chamber 80 or the passage 188 of conventional carburetors is very detrimental to proper operation of the carburetor because it changes the operating pressure of its fuel metering chamber which is critical to the function of the carburetor. The check valve 112 isolates the metering chamber 80 from the inlet passage 188 during engine operation to reduce the potential for leaks which will affect the operating pressure of the metering chamber 80.

Figure 4:
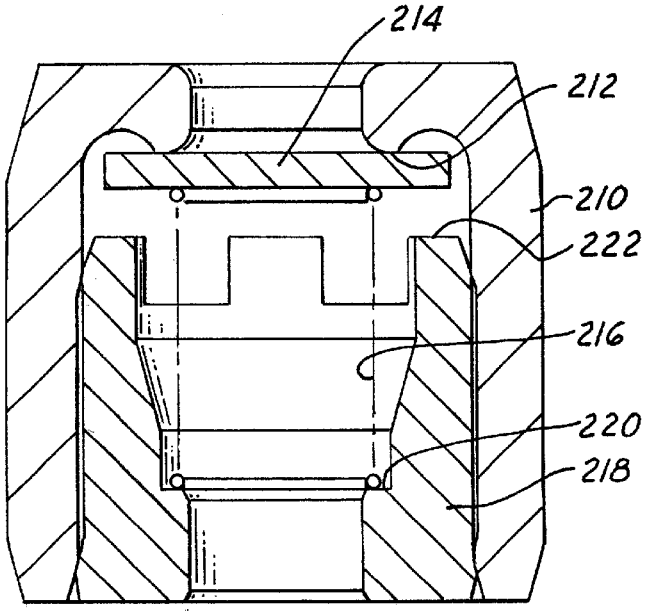
FIG. 4 is an enlarged fragmentary sectional view illustrating a check valve construction utilized in the carburetor.

Desirably, each of the check valves 112, 170, 192, 200 in the carburetor 10 can be formed from common parts. As shown in FIG. 4, the check valves may comprise a housing 210 defining a valve seat 212, a valve disk 214 yieldably biased by a valve spring 216 onto the valve seat 212 and a spacer 218 having a shoulder 220 which engages one end of the spring 216 to permit the working length of the spring 216 to be altered by changing the axial position of the spacer 218 relative to the housing 210. The spacer 218 also provides a stop 222 which limits the extent to which the disk 214 can be moved from its seat. By removing the spring 216 which biases the valve disk 214, the check valves 200, 170 suitable for use on the fuel outlet 108 of the fuel metering chamber 80 as well as adjacent to the high speed fuel nozzle 156, respectively, may be provided. With these check valves 170, 200, the valve disk 214 is simply moved between the stop surface 222 of the spacer 218 and the valve seat 212 in response to a pressure differential across the valve disk 214. To change the operating characteristics of the check valves 112, 192 in addition to changing the working length of the spring 216, a different spring having a different spring rate can be provided and the valve disk 214 can be formed of a different material. By using a common valve seat housing 210, valve disk 214, spring 216, if any, and spacer 218, the volume of production of the check valves 112, 170, 192, 200 can be increased thereby lowering their individual piece price.

Cold Start Enrichment

Figure 5:
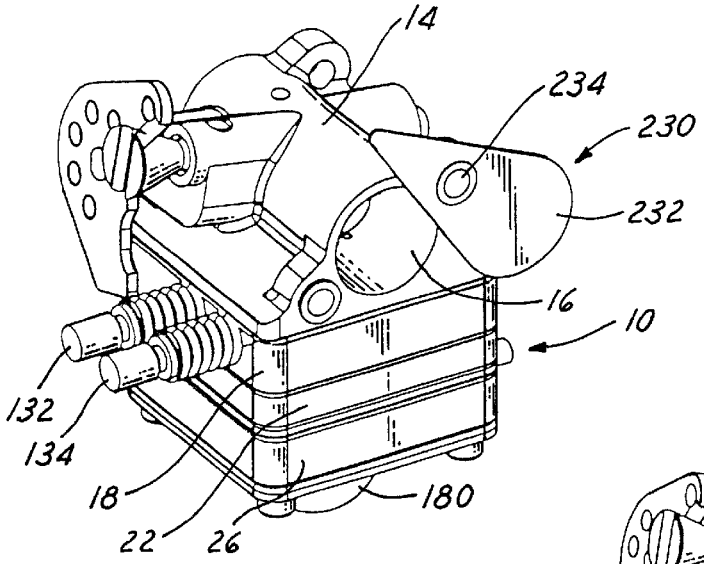
FIG. 5 is a perspective view of a carburetor according to FIG. 1 illustrating a choke valve in an open position.
Figure 6:
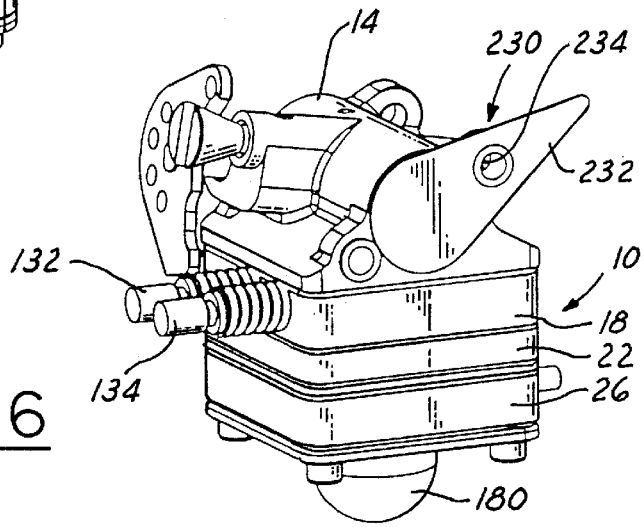
FIG. 6 is a perspective view of the carburetor of FIG. 5 illustrating the choke valve in its closed position.

As shown in FIG. 5, the carburetor 10 preferably also comprises a cold start enrichment assembly 230 to provide a richer than normal fuel and air mixture to the engine to facilitate starting the engine. The cold start enrichment system 230 has a guillotine choke valve 232 pivotally carried on a shaft 234 fixed to the throttle valve plate 14. The choke valve 232 is movable between an open position, as shown in FIG. 5, to permit normal operation of the carburetor and engine and a closed position, as shown in FIG. 6, to facilitate starting of the engine. To start the engine, the throttle valve 162 is moved to its wide open position and the choke valve 232 is moved to its closed position (FIG. 6) blocking off one end of the fuel and air mixing passage 16 and directing all engine manifold vacuum to the primary idle fuel jets 164, secondary fuel jets 166, 168 and the high speed fuel nozzle 156. When the engine is rotated by the starter mechanism, the manifold vacuum pressure draws fuel into the engine manifold through the fuel jets and fuel nozzle. Because the revolutions of the engine are slow during the starting procedure, the engine manifold vacuum is of a lower magnitude than at normal engine operating speeds but the fuel demands required to start the engine are greater. The choke valve 232 in its closed position ensures that a sufficient vacuum pressure is directed in the fuel and air mixing passage 16 to provide sufficient fuel for the starting of the engine. After the engine is started, the choke valve 232 is moved back to its open position (FIG. 5) to permit normal operation of the carburetor 10 and engine.

Figure 7:
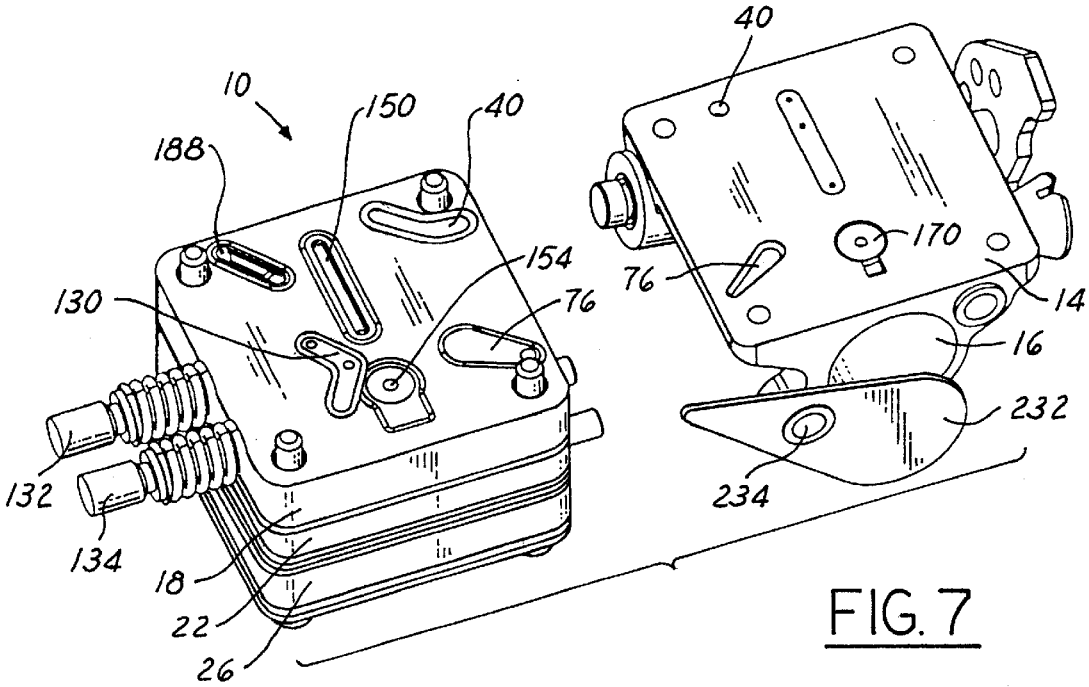
FIG. 7 is a perspective view of a carburetor of FIG. 5 illustrating a throttle valve plate removed from a carburetor and the various passages between the remainder of the carburetor and the throttle valve plate.
Figure 8:
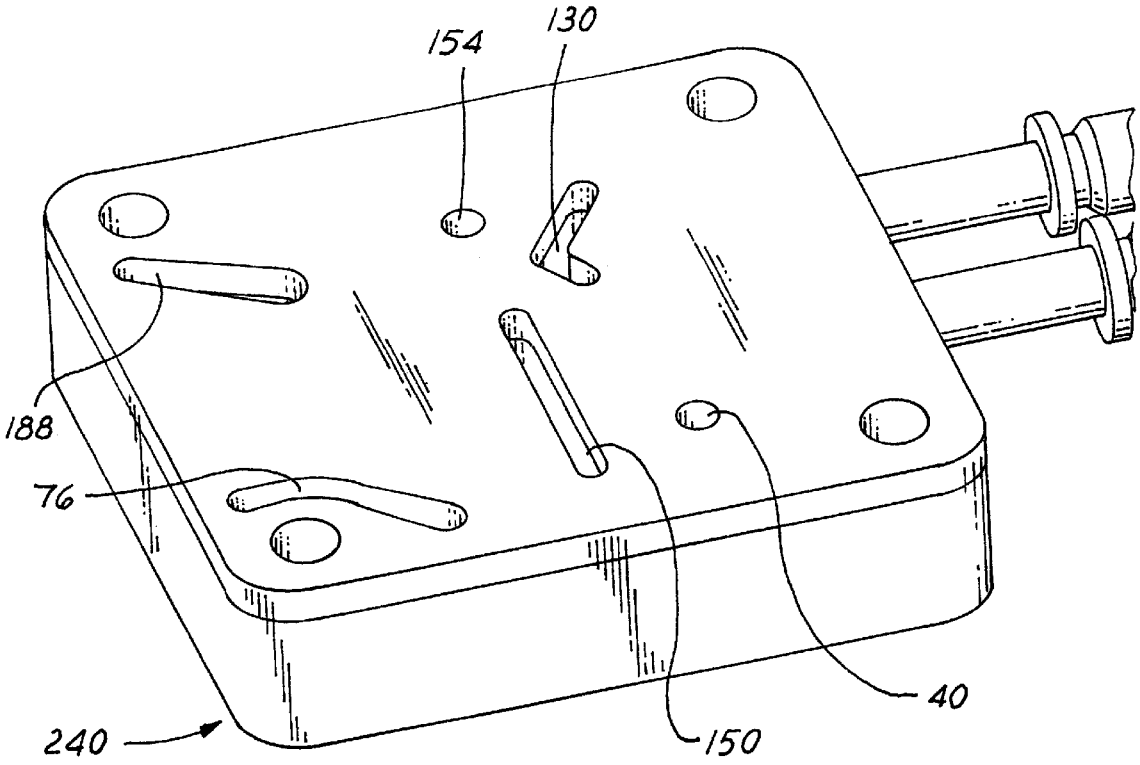
FIG. 8 is a perspective view of a modified gasket for use with a carburetor according to the invention.

As shown in FIG. 8, a thicker gasket 240 may be provided between the fuel metering plate 18 and the throttle valve plate 14 to reduce or eliminate the cavities, as shown in FIG. 7, formed in the fuel metering plate 18 and throttle valve plate 14 for the fuel progression pocket 150, the fuel delivery passage 130, the air purge inlet passage 188 and the fuel metering inlet passage 76, pressure pulse passage 40 and high speed fuel delivery passage 154. Rather than form portions of these fuel passages in the face of the fuel metering plate 18, they may be formed in the gasket 240 to further facilitate manufacture and assembly of the carburetor. This concept can be utilized elsewhere in the carburetor 10 as desired to facilitate manufacture of the carburetor.

Second Embodiment

Figure 9:
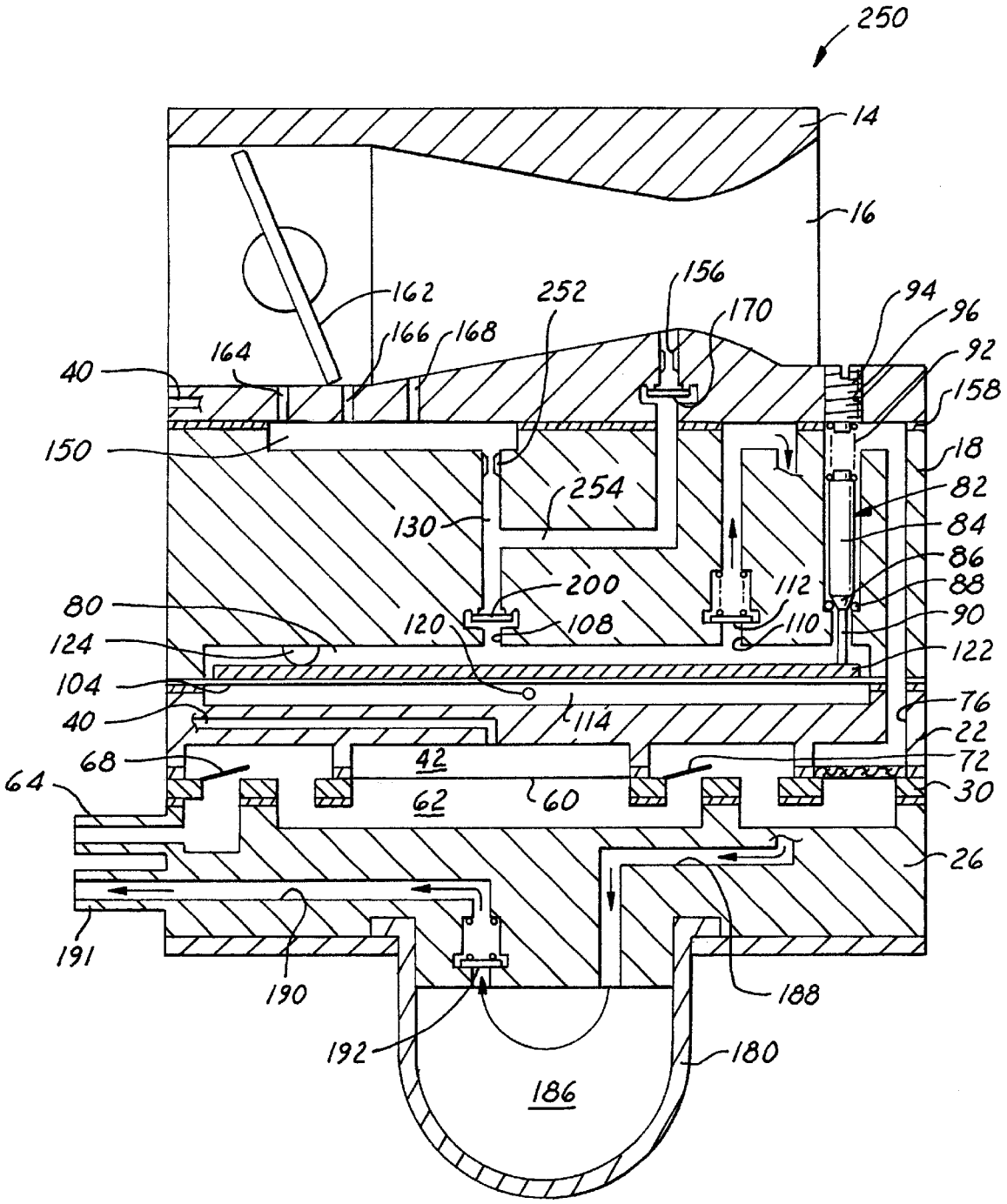
FIG. 9 is sectional view of a second embodiment of a carburetor according to the present invention illustrating a modified fuel delivery system.

FIG. 9 illustrates a second embodiment of a carburetor 250 embodying the present invention which utilizes a fixed restriction 252 within the main fuel delivery passage 130 upstream of the fuel progression pocket 150 and downstream of a high speed fuel delivery passage 254 leading to the high speed fuel nozzle 156. The carburetor 250 does not utilize either a low speed or high speed adjustable needle valve to control the flow rate of fuel to the fuel jets 164, 166, 168 or the high speed fuel nozzle 156. Fuel flow to the primary and secondary fuel jets 164, 166, 168 occurs in generally the same manner as in the first embodiment carburetor, namely, in response to opening of the throttle valve 162 to apply a manifold vacuum pressure to the fuel jets as previously described. Before a sufficient manifold vacuum pressure is applied to the high speed fuel nozzle 156 to cause fuel to flow therethrough, air flow from the fuel air mixing passage 16 is prevented from flowing through the high speed fuel delivery passage by the check valve 170 which only permits the flow of liquid fuel from the high speed fuel delivery passage 254 to the fuel and air mixing passage 16.

At idle and low speed engine operation, fuel flows from the fuel metering chamber 80 through its fuel outlet 108 and the check valve 200 therein into the main fuel delivery passage 130. Fuel in the main fuel delivery passage 130 passes through the fixed restriction 252 which controls the rate at which fuel flows into the 15 fuel progression pocket 150 and hence, the rate which fuel is available to the primary idle and secondary fuel jets 164, 166, 168. When the engine is accelerated to wide open throttle operation, such that a sufficient manifold vacuum is applied to the high speed fuel nozzle 156, fuel is drawn from the main fuel delivery passage 130 into the high speed fuel delivery passage 254 to be fed into the fuel and air mixing passage 16 through the high speed fuel nozzle 156. The fuel which flows to the high speed fuel delivery passage 254 does not flow through the fixed restriction 252 which is downstream thereof. Thus, to properly control the fuel flow through the carburetor 10, the size and location of the primary fuel jet 164 and secondary fuel jets 166, 168 in relation to each other and the throttle valve 162, and the size of the fixed restriction 252 are controlled for optimal operation of a specific engine family.

In general, the amount of fuel metered through the carburetor 10 is a 5 function of the restrictions in the high speed and low speed fuel circuits and a pressure differential between the engine manifold and the fuel metering chamber 80. The amount of fuel flow for optimal performance varies from one engine to another in the same engine family requiring the carburetors 250 to be calibrated and adjusted. In many carburetors, these calibrations and adjustments are done by adjusting high speed and low speed needle valves, and this adjustment can be difficult to accurately perform. In the carburetor 250 shown in FIG. 9, fuel flow rate modification or adjustment is achieved by changing the operating pressure of the fuel metering chamber 80 by moving the adjustment member or screw 94 to adjust the working length of the spring 92 biasing the fuel inlet valve 82. Shortening the working length of the spring 92 increases the force the spring 92 exerts on the inlet valve 82 and requires an increased operating vacuum of the metering chamber 80 to open the inlet valve 82. In contrast, increasing the working length of the spring 92 decreases the spring force exerted on the inlet valve 82 and decreases the magnitude of the vacuum of the fuel metering chamber 80 required to open the inlet valve 82.

Third Embodiment

Figure 10:
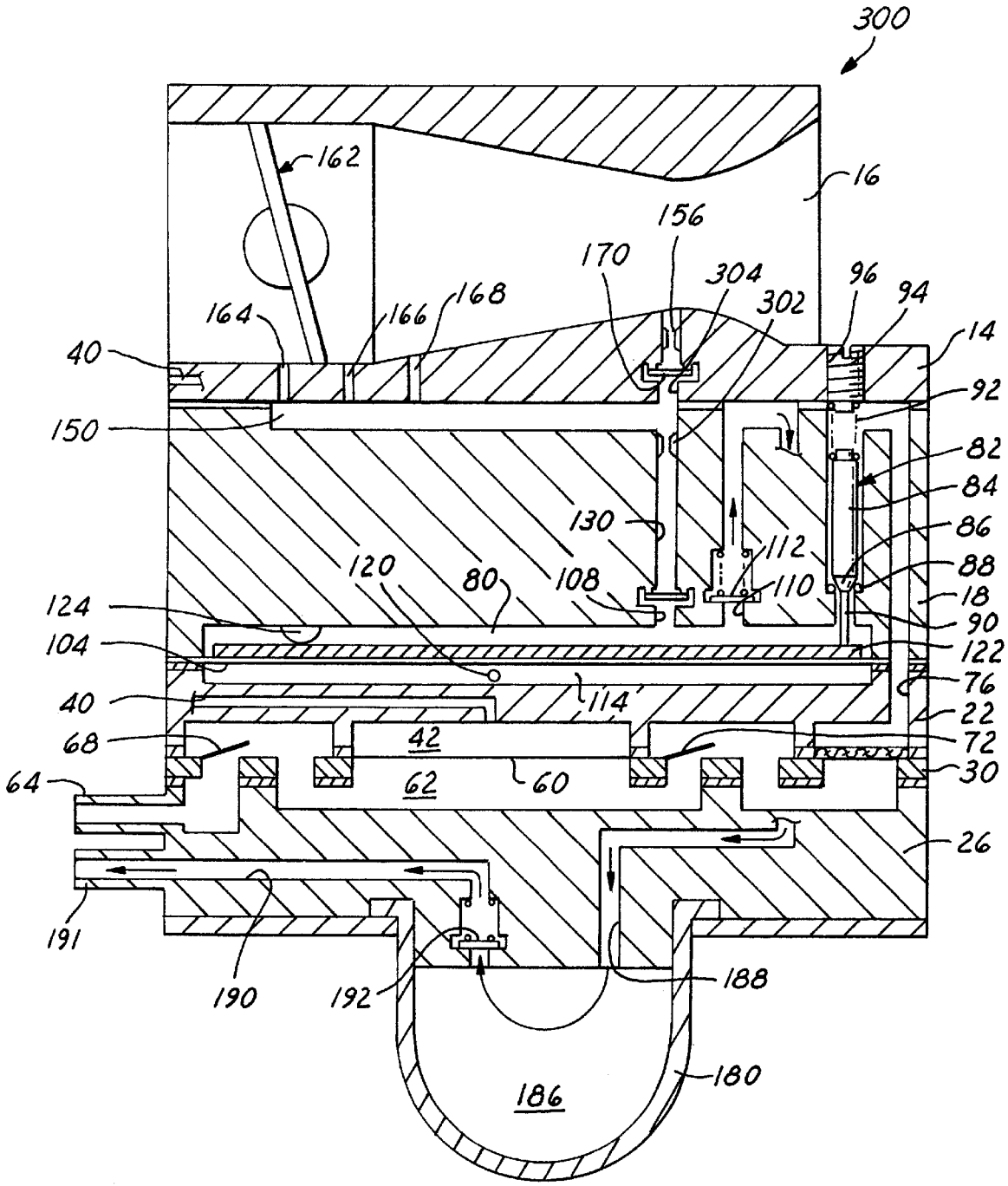
FIG. 10 is a sectional view of a carburetor according to a third embodiment of the invention illustrating an alternate fuel delivery system.

A third embodiment of a carburetor 300 embodying the invention is shown in FIG. 10 and has a fixed restriction 302 upstream of both the high speed fuel delivery passage 304 leading to the high speed fuel nozzle 156 and the fuel progression pocket 150 leading to the primary idle and secondary fuel jets 164, 166, 168. In this embodiment of the carburetor 300, the fixed restriction 302 also controls the fuel delivered to the high speed fuel nozzle 156 and not just the fuel delivered to the primary idle and secondary fuel jets 164, 166, 168 as in the second embodiment carburetor 250. There are no high speed or low speed needle valves to adjust the flow rate through the carburetor 300. Rather, the flow rate of fuel through the carburetor 300 is controlled by the restriction 302, and the size and spacing of the primary idle and secondary fuel jets 164, 166, 168 and the high speed fuel nozzle 156. The third embodiment carburetor 300 is calibrated in the same manner as the second embodiment carburetor 250 by adjusting the working length of the spring 92 to control the magnitude of the operating vacuum of the fuel metering chamber 80. In all other aspects, the third embodiment carburetor 300 functions and is constructed in the same manner of the first and second embodiments of the carburetor 10, 250.

Fourth Embodiment

Figure 11:
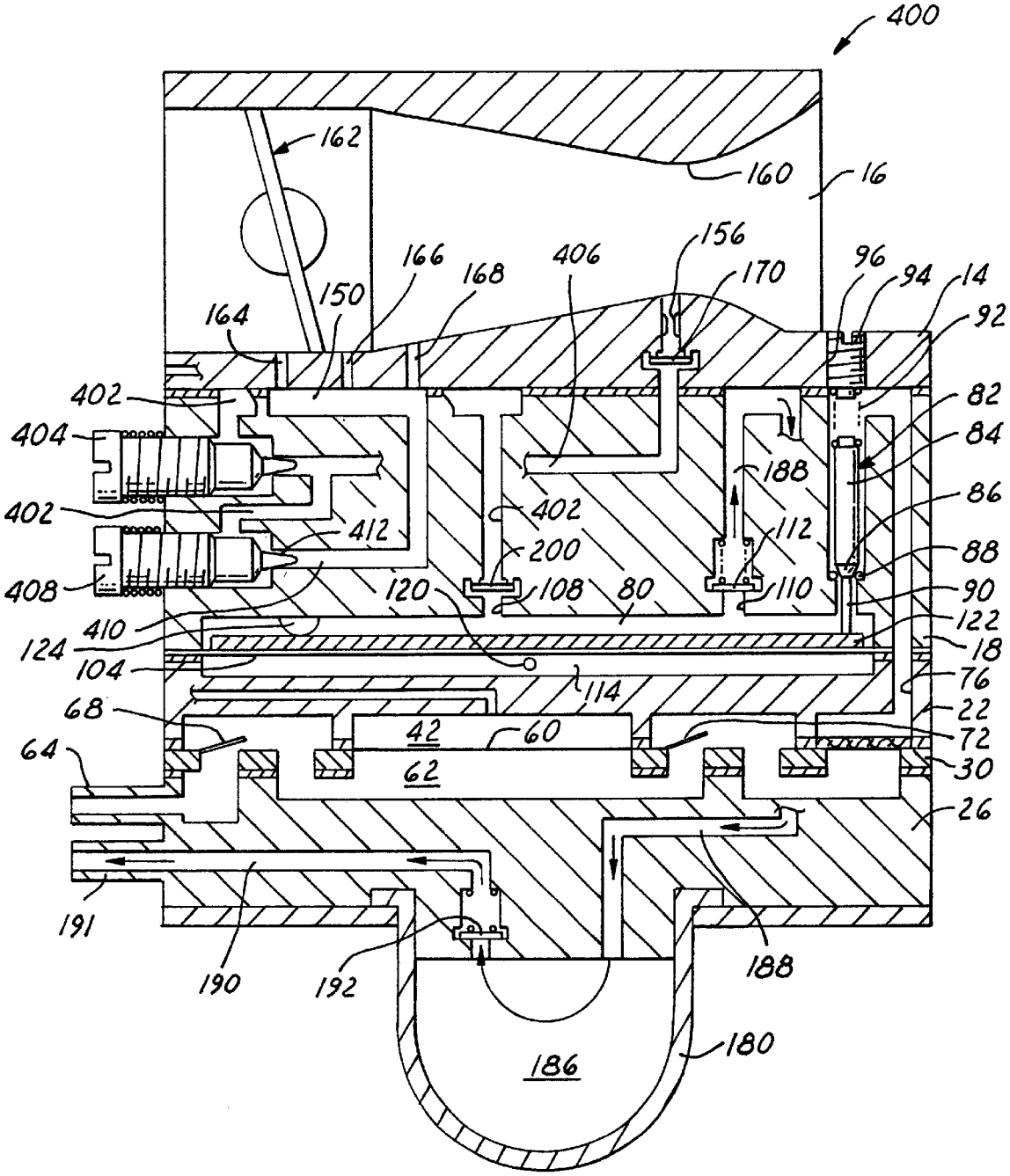
FIG. 11 is a cross sectional view of a carburetor according to a fourth embodiment of the present invention.

A fourth embodiment of a carburetor 400 according to the present invention is shown in FIG. 11 and has a main fuel delivery passage 402 through which fuel flows first to a high speed needle valve 404 which restricts flow to a high speed fuel delivery passage 406 and the high speed fuel nozzle 156, and thereafter to a low speed needle valve 408 which restricts fuel flow to a low speed fuel delivery passage 410 which opens to the fuel progression pocket 150 to provide fuel to the primary idle and secondary fuel jets 164, 166, 168. This carburetor 400 is constructed in substantially the same manner as the first embodiment carburetor 10 with the exception that the low speed needle valve 408 is downstream of the high speed needle valve 404 in this carburetor 300 whereas in the first embodiment carburetor 10 the low speed needle valve 132 was upstream of the high speed needle valve 134.

In operation of the fourth embodiment carburetor 400, as the engine is accelerated to wide open throttle operation, the throttle valve 162 is fully opened and the manifold vacuum reaches the high speed fuel nozzle 156 creating a pressure drop across the nozzle in addition to the pressure drop created by the air flow through the venturi 160. These vacuum pulses are also transmitted back to the low speed fuel circuit through the portion of the fuel delivery passage 402 between the high speed needle valve 404 and low speed needle valve 408, through the low speed delivery passage 410, the fuel progression pocket 150, and the fuel jets 164, 166, 168. As these vacuum pulses transmitted back through the low speed fuel circuit become stronger, the fuel flow through the fuel jets 164, 166, 168 decreases. At some point, the vacuum pulses become so strong that fuel flow stops and air enters the fuel jets 164, 166, 168, fuel progression pocket 150 and low speed fuel delivery passage 410. Typically, a capillary seal of the liquid fuel in the flow gap between the low speed needle valve 408 and its valve seat 412 prevents the air from being bled into the high speed fuel circuit. If the capillary seal is not strong enough, a check valve may be provided to prevent the reverse flow of air into the high speed fuel delivery passage 406.

As in the first embodiment carburetor 10, the high speed needle valve 404 is adjusted to control the fuel flow rate at high engine operating speeds. The low speed needle valve 408 is adjusted to control the fuel flow rate at low engine speeds and loads. The annular flow area at the high speed needle valve 404 is preferably large enough so that it does not cause a restriction to the fuel flowing through the low speed fuel circuit (i.e. the flow area of the high speed needle valve 404 is greater than the flow area of the low speed needle valve 408). In all other aspects, the fourth embodiment carburetor 400 functions the same as the first embodiment carburetor 10 and hence, it will not be described further.

Fifth Embodiment

Figure 12:
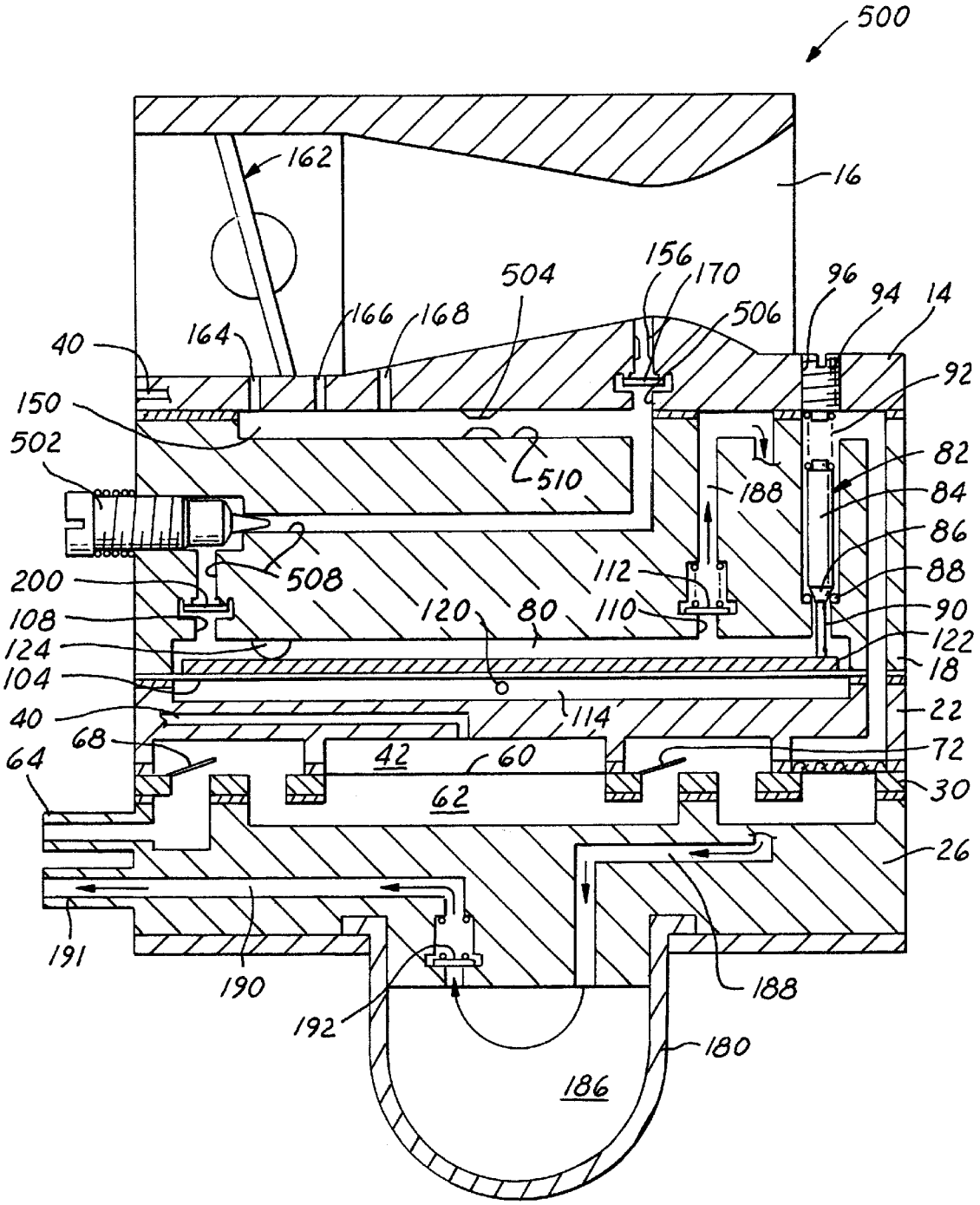
FIG. 12 is a sectional view of a carburetor according to a fifth embodiment of the present invention.

FIG. 12 shows a fifth embodiment of a carburetor 500 according to the present invention having a high speed adjustable needle valve 502 and a fixed restriction 504 between a high speed fuel delivery passage 506 and the fuel progression pocket 150 which controls the flow rate of fuel to the progression pocket 150. The high speed needle valve 502 is adjustable to control the size of its flow area to control the rate of fuel delivered through a main fuel delivery passage 508 which leads to both a low speed fuel delivery passage 510 and the high speed fuel delivery passage 506. The high speed fuel nozzle 156 is located in the high speed fuel delivery passage 506 without any restriction directly between it and the high speed needle valve 502. The primary idle and secondary fuel jets 164, 166, 168 are located downstream of the fuel progression pocket 150 which in turn is downstream of the fixed restriction 504 which controls the flow rate of fuel to the progression pocket 150.

The fuel flow through the primary idle and secondary fuel jets 164, 166, 168 occurs in substantially the same fashion as the previous embodiment carburetors and hence will not be described further. A check valve 170 may be provided to control the fluid flow through the high speed fuel nozzle 156 to the fuel air mixing passage 16 and to prevent the reverse flow of fluid from the high speed fuel nozzle 156 to the main fuel delivery passage 508. At least at low speed engine operation, the check valve 170 prevents air from bleeding from the fuel and air mixing passage 16 into the main fuel delivery passage 508 or low speed fuel delivery passage 510. At wide open throttle engine operation, the vacuum pulses create a significant pressure drop across the high speed fuel nozzle 156 in addition to the pressure drop created by the flow of air through the venturi 160, to draw liquid fuel through the high speed fuel nozzle 156 into the fuel and air mixing passage 16 for delivery to the engine. Desirably, almost all of the fuel required by of the engine at wide open throttle operation is supplied through the high speed fuel nozzle 156.

In some engines it may be desirable to bleed air through the high speed fuel nozzle 156 to control the fuel and air mixture delivered from the primary idle and secondary fuel jets 164, 166, 168 as opposed to providing liquid fuel through the high speed fuel nozzle 156. To ensure that air is bleed through the high speed fuel nozzle 156 and not fuel, the high speed fuel nozzle 156 is located further upstream in the venturi 160 so that the manifold vacuum pulses will not be strong enough to induce fuel flow therethrough, but rather, air continues to bleed through the high speed fuel nozzle 156 even at wide open throttle operation. Hence, all fuel flow for wide open throttle engine operation is provided by the primary and secondary fuel jets 164, 166, 168. Regardless of whether the high speed fuel nozzle is designed to bleed air back into the carburetor 500 or to provide fuel to the fuel and air mixing passage 16 at high engine speeds, the remainder of the carburetor 500 is constructed substantially the same as the previous embodiments of the carburetor and hence, it will not be described further.

What is claimed is:

1. A carburetor, comprising:

a body;

a fuel metering diaphragm having opposed sides carried by the body and being responsive to a difference in pressure on its opposed sides;

an air chamber defined between one side of the diaphragm and the body;

a fuel metering chamber defined between the other side of the diaphragm and the body and having an inlet in communication with a supply of fuel and an outlet from which fuel is discharged from the fuel metering chamber;

an inlet valve having an annular valve seat and a valve body with a valve head selectively engageable with the valve seat to prevent fluid flow through the valve seat and a needle extending through the valve seat and into the fuel metering chamber, the valve being yieldably biased to a closed position with the valve head on the valve seat preventing fuel flow from the inlet into the fuel metering chamber and movable to an open position with the valve head separated from the valve seat to permit fuel flow into the fuel metering chamber; and a substantially rigid disk disposed in the fuel metering chamber and responsive to movement of the diaphragm to selectively engage and move the needle and the inlet valve to its open position with the valve head separated from the valve seat permitting fuel to flow into the fuel metering chamber when the differential pressure across the diaphragm displaces it sufficiently towards the inlet valve.

2. The carburetor of claim 1 which also comprises at least one fixed pivot carried by the body, extending into the fuel metering chamber and engageable with the disk to cause the disk to pivot about the fixed pivot to facilitate opening the inlet valve in response to movement of the diaphragm toward the fixed pivot.

3. The carburetor of claim 2 wherein the fixed pivot is disposed adjacent to one side of the disk and the needle is disposed adjacent to an opposed side of the disk with both the fixed pivot and the needle spaced inwardly of a periphery of the disk.

4. The carburetor of claim 1 wherein the disk is maintained against the diaphragm by capillary forces between them.

5. The carburetor of claim 1 which also comprises a spring yieldably biasing the inlet valve to its closed position and an adjustment member carried by the body to permit adjustment of the working length of the spring to permit adjustment of the spring force acting on the inlet valve.

6. The carburetor of claim 5 wherein the adjustment member is a screw received in a threaded bore in the body open to the exterior of the body to permit adjustment of the position of the screw relative to the body to change the working length of the spring.

7. The carburetor of claim 6 which also comprises a plug inserted into the threaded bore after adjustment of the screw to prevent further adjustment of the screw without first removing the plug.

8. The carburetor of claim 1 wherein the fuel metering diaphragm is formed of high density polyethylene and is adapted to swell when exposed to liquid fuel to increase its flexibility.

9. The carburetor of claim 8 wherein the fuel metering diaphragm is a generally flat sheet.

10. The carburetor of claim 1 wherein the fuel metering chamber is defined in part by a cavity in the body having generally rectilinear walls without any pockets formed therein and with openings into the fuel metering chamber communicating only with fluid passages leading into and out of the fuel metering chamber.

11. The carburetor of claim 10 which also comprises a fuel inlet defined in part by the inlet valve which receives fuel into the fuel metering chamber, a fuel outlet through which fuel exits the fuel metering chamber and a purge outlet communicating with the fuel metering chamber and wherein the fuel inlet, fuel outlet and purge outlet each define a separate opening into the fuel metering chamber.

12. The carburetor of claim 1 which also comprises a fuel metering gasket carried by the body adjacent to the fuel metering diaphragm and wherein the body comprises at least two plates connected together with the fuel metering diaphragm disposed between two plates of the body in assembly with the fuel metering gasket trapped between one plate and the side of the diaphragm which defines in part the air chamber.

13. The carburetor of claim 1 which also comprises a spring yieldably biasing the valve head toward the valve seat; and an adjustment member carried by the body in engagement with the spring and being movable relative to the body to adjust the biasing force the spring exerts on the inlet valve and thereby adjust the force required to displace the valve head from the valve seat and permit fuel to flow into the fuel metering chamber.

14. The carburetor of claim 13 wherein said adjustment member has external threads and is received in a threaded bore in the body open to the exterior of the body and may be rotated to alter its position relative to the body.

15. The carburetor of claim 13 wherein the spring is a coil spring and movement of the adjustment member changes the working length of the spring.

16. The carburetor of claim 13 which also comprises a plug inserted into the body after adjustment of the adjustment member to prevent access to the adjustment member.

17. A carburetor, comprising:

a body defined at least in part by a plurality of plates connected together including an end plate, a fuel pump plate having opposed sides with one side adjacent to the end plate, a fuel metering plate having opposed sides with one side adjacent to the other side of the fuel pump plate and a throttle valve plate adjacent to the other side of the fuel metering plate;

the plates being superimposed with the opposed sides being planar and parallel to each other, a fuel pump defined between and in part in each of the fuel pump plate and the end plate and having a fuel pump diaphragm carried by the body between the fuel pump plate and the end plate to define a pressure pulse chamber on one side of the fuel pump diaphragm which is adapted to communicate with a crankcase of an engine with which the carburetor is used and a fuel pump chamber on the other side of the fuel pump diaphragm having an inlet in communication with a fuel reservoir and an outlet through which fuel is discharged under pressure;

a fuel metering assembly defined in part in each of the fuel pump plate and the fuel metering plate, having a fuel metering diaphragm carried by the body between the fuel pump plate and the fuel metering plate to define in part a pressure reference chamber on one side and a fuel metering chamber on its other side with a fuel inlet which receives fuel from the fuel pump into the fuel metering chamber and a fuel outlet through which fuel exits the fuel metering chamber;

a main fuel delivery passage which communicates the fuel outlet of the fuel metering chamber with a low speed fuel delivery passage and a high speed fuel delivery passage;

a fuel and air mixing passage through and defined at least in part in the throttle valve plate;

at least one low speed fuel jet communicating the low speed fuel delivery passage with the fuel and air mixing passage; and at least one high speed fuel nozzle communicating the high speed fuel delivery passage with the fuel and air mixing passage.

18. The carburetor of claim 17 which also comprises at least one restriction to fuel flow upstream of at least one of the low speed fuel jet and high speed fuel nozzle to control the flow rate of fuel provided to said at least one of them.

19. The carburetor of claim 18 wherein the restriction is a fixed restriction located in the main fuel delivery passage.

20. The carburetor of claim 18 wherein the restriction is a variable restriction in the form of a needle valve having a valve seat defining in part the main fuel delivery passage and a needle shaped valve head movable relative to the valve seat to change the flow area of the restriction.

21. The carburetor of claim 20 which also comprises a fixed restriction disposed in the low speed fuel delivery passage.

22. The carburetor of claim 19 wherein the fixed restriction is downstream of the high speed fuel delivery passage.

23. The carburetor of claim 19 wherein the fixed restriction is upstream of both the low speed fuel jet and the high speed fuel nozzle.

24. The carburetor of claim 18 which also comprises a second restriction defining in part the high speed fuel delivery passage and wherein the first restriction defines in part the low speed fuel delivery passage.

25. The carburetor of claim 24 wherein both the first and second restrictions are needle valves adjustably carried by the body to control fuel flow to their respective one of the high speed fuel delivery passage and low speed fuel delivery passage.

26. The carburetor of claim 25 wherein the high speed fuel delivery passage communicates with the main fuel delivery passage downstream of the location at which the low speed fuel delivery passage communicates with the main fuel delivery passage.

27. The carburetor of claim 25 wherein the low speed fuel delivery passage communicates with the main fuel delivery passage downstream of the location at which the high speed fuel delivery passage communicates with the main fuel delivery passage.

28. The carburetor of claim 27 wherein the second restriction has a larger flow area than the first restriction.

29. The carburetor of claim 17 which also comprises an air purge assembly defined in part in the end plate and having a compressible bulb defining a bulb chamber, an air purge inlet passage communicating the bulb chamber with the fuel metering chamber through a purge outlet of the fuel metering chamber, an air purge outlet passage communicating the bulb chamber with a fuel reservoir, a first check valve carried by the end plate to prevent fluid flow from the fuel reservoir to the bulb chamber and to permit the reverse flow under at least some conditions and a second check valve carried by the fuel metering plate to prevent fluid flow from the bulb chamber to the fuel metering chamber and to permit the reverse flow under at least some conditions.

30. The carburetor of claim 29 wherein the second check valve has a valve head yieldably biased by a spring onto a valve seat to close the check valve until a sufficient pressure differential exists across the valve head to displace it from the its valve seat.

31. The carburetor of claim 29 wherein the first and second check valves are identical in structure and may be assembled into the carburetor body from the same direction.

32. The carburetor of claim 17 wherein the fuel metering chamber is defined in part by a cavity open to one face of the fuel metering plate.

33. The carburetor of claim 17 wherein the end plate has a generally planar face and the fuel pump chamber is defined in part by a cavity open to said generally planar face of the end plate.

34. The carburetor of claim 17 wherein the pressure pulse chamber is defined in part by a cavity open to one side of the fuel pump plate that is adjacent to the end plate.

35. The carburetor of claim 17 which also comprises a fuel progression pocket communicating with the low speed fuel delivery passage and at least two fuel jets communicating the progression pocket with the fuel and air mixing passage and wherein the progression pocket is defined in part by a cavity open to said other side of the fuel metering plate.

36. The carburetor of claim 17 wherein a portion of the low speed fuel delivery passage extending parallel to said other face of the fuel metering plate is defined in part by a cavity in said other face of the fuel metering plate.

37. The carburetor of claim 35 which also comprises a gasket between the fuel metering plate and the throttle valve plate and wherein the progression pocket is defined within the gasket and between generally flat faces of the fuel metering plate and the throttle valve plate.

38. A carburetor, comprising:

a body defined at least in part by a plurality of plates connected together including an end plate having a side with a planar face, a throttle valve plate having a side with a planar face, a fuel metering plate having opposed sides with planar faces, and a fuel pump plate having opposed sides with planar faces, one side of the fuel pump plate adjacent to one of the end plate and the throttle valve plate and the other side of the fuel pump plate adjacent to one side of the fuel metering plate, and with the other side of the fuel metering plate adjacent to one of the throttle valve plate and the end plate which is not adjacent to the fuel pump plate;

all of said plates being stacked together with said planar faces parallel to each other, adjacent planar faces of adjacent plates opposed to each other, and the adjacent planar faces of adjacent plates lapping each other and extending to the periphery of their associated plates;

a fuel pump defined between and in part in each of the fuel pump plate and said one of the end plate and throttle valve plate and having a fuel pump diaphragm carried by the body between the fuel pump plate and said one of the end plate and throttle valve plate to define a pressure pulse chamber on one side of the fuel pump diaphragm which is adapted to communicate with a crankcase of an engine with which the carburetor is used and a fuel pump chamber on the other side of the fuel pump diaphragm having an inlet in communication with a fuel reservoir and an outlet through which fuel is discharged under pressure; and a fuel metering assembly defined in part in each of the fuel metering plate and an adjacent plate, having a fuel metering diaphragm carried by the body between the fuel metering plate and the adjacent plate to define in part a pressure reference chamber on one side and a fuel metering chamber on its other side with a fuel inlet which receives fuel from the fuel pump into the fuel metering chamber and a fuel outlet through which fuel exits the fuel metering chamber; and a fuel and air mixing passage defined at least in part in the throttle valve plate through which air flows to be mixed with liquid fuel from the fuel outlet of the fuel metering chamber for delivery as a fuel and air mixture to an engine.

39. The carburetor of claim 38 which also comprises a gasket received between the adjacent planar faces of the throttle plate and the adjacent plate and having within its perimeter and thickness at least one cavity forming a pocket or a passage of the carburetor which is wholly within the thickness of the gasket and between the adjacent planar faces engaging the gasket.

40. A carburetor, comprising:

a body defined at least in part by a plurality of plates connected together including an end plate having a side with a planar face, a fuel pump plate having opposed sides with planar faces with one side adjacent to the end plate, a fuel metering plate having opposed sides with planar faces with one side adjacent to the other side of the fuel pump plate and a throttle valve plate having a side with a planar face adjacent to the other side of the fuel metering plate;

all of said plates being stacked together with said planar faces parallel to each other, adjacent planar faces of adjacent plates opposed to each other, and the adjacent planar faces of adjacent plates lapping each other and extending to the periphery of their associated plates;

a fuel pump defined between and in part in each of the fuel pump plate and the end plate and having a fuel pump diaphragm carried by the body between the fuel pump plate and the end plate to define a pressure pulse chamber on one side of the fuel pump diaphragm which is adapted to communicate with a crankcase of an engine with which the carburetor is used and a fuel pump chamber on the other side of the fuel pump diaphragm having an inlet in communication with a fuel reservoir and an outlet through which fuel is discharged under pressure;

a fuel metering assembly defined in part in each of the fuel metering plate and the fuel pump plate, having a fuel metering diaphragm carried by the body between the fuel pump plate and the fuel metering plate to define in part a pressure reference chamber on one side and a fuel metering chamber on its other side with a fuel inlet which receives fuel from the fuel pump into the fuel metering chamber and a fuel outlet through which fuel exits the fuel metering chamber; and a fuel and air mixing passage defined at least in part in the throttle valve plate through which air flows to be mixed with liquid fuel from the fuel outlet of the fuel metering chamber for delivery as a fuel and air mixture to an engine.

* * * * *